US005750945A

United States Patent [19]

Fuller et al.

[11] Patent Number: 5,750,945

[45] Date of Patent: May 12, 1998

[54] ACTIVE ELEVATOR HITCH

[75] Inventors: James W. Fuller; Randall K. Roberts, both of Amston, Conn.

[73] Assignee: Otis Elevator Company, Farmington, Conn.

[21] Appl. No.: 659,065

[22] Filed: Jun. 3, 1996

[51] Int. Cl.[6] ..... B66B 1/34; B66B 7/08

[52] U.S. Cl. ..... 187/292; 187/411; 187/393

[58] Field of Search ..... 187/393, 394, 187/292, 411

[56] References Cited

U.S. PATENT DOCUMENTS

| | | | |
|---|---|---|---|
| 5,027,925 | 7/1991 | Kahkipuro | 187/115 |
| 5,086,882 | 2/1992 | Sugahara et al. | 187/95 |
| 5,490,577 | 2/1996 | Yoo | 187/252 |
| 5,542,501 | 8/1996 | Ikjima et al. | 187/292 |

FOREIGN PATENT DOCUMENTS

| | | | |
|---|---|---|---|
| 60-15374 | 1/1985 | Japan | B66B 1/06 |
| 61-22675 | 6/1986 | Japan | B66B 7/08 |
| 1156293 | 6/1989 | Japan | B66B 11/02 |
| 1197294 | 8/1989 | Japan | B66B 7/04 |
| 6329368 | 11/1994 | Japan | B66B 9/02 |
| 2271865 | 4/1994 | United Kingdom | G05B 13/04 |

*Primary Examiner*—Robert Nappi

[57] ABSTRACT

An elevator motion control system compares a dictated flight path signal (101), indicative of a desired elevator flight path along a nominal flight trajectory, with a measured flight path signal (108), indicative of actual elevator motion, and provides a motion command signal (115) to both a high pass filter (117) and a low pass filter (116) such that the frequency of the motion command signal is split into high and low frequency components (141,118). An active elevator hitch (36) is used to implement the high frequency/low stroke portion of the motion command signal while the elevator motor (28) is used to implement the low frequency/high stroke portion of the motion command signal. A time delay (106) delays the dictated flight path signal prior to its use with the measured flight path signal for providing the motion command signal, the duration of the time delay corresponding to the delay associated with a motion perturbation propagating along a main rope (14) between the elevator motor and the elevator car (12). The active elevator hitch (36) includes a support plate (40) interconnected to the elevator car, a hitch plate (46), and at least one force actuator (56) having a variable extension. The force actuator is connected between the hitch plate and the support plate, and the variable extension is controlled for varying the vertical position of the elevator car along the elevator flight path for damping at least the high frequency components of elevator car vertical oscillations.

26 Claims, 5 Drawing Sheets

ACTIVE ELEVATOR HITCH

TECHNICAL FIELD

The present invention relates to elevator motion control and more particularly to an active elevator hitch for improved elevator motion control.

BACKGROUND OF THE INVENTION

Elevators are controlled to follow a flight profile which minimizes flight time within certain jerk, acceleration, and velocity constraints. The constraints are selected to ensure a comfortable ride. In practice, elevator vertical motion includes oscillations about the nominal trajectory that reduce ride comfort. These oscillations are primarily due to various spring/mass oscillation modes of the compliant rope between the elevator motor and the car. These oscillation modes are very lightly damped and thus can be set in motion by small disturbances that occur in flight. These small disturbances include passenger motion, rail joints, mechanical wear, torque ripple produced by the drive and motor, air pressure changes due to passing floor sills, other cars, and structural members in the hoistway, etc.

Elevator motion control is the mechanism by which the elevator is made to follow the nominal flight trajectory. Elevator motion control is typically accomplished using an elevator motion controller. In the elevator motion controller, the nominal trajectory to be followed by the elevator is input in terms of a dictated velocity of the elevator car along the trajectory. The dictated velocity is used to form the nominal commanded speed for the elevator motor. The position of the elevator car is measured and used to determine a distance to go estimate which is used to determine a correction to this nominal velocity command to ensure that the elevator lands at its desired destination in a smooth and controlled manner within a desired landing accuracy.

The motion controller also typically includes a machine room motor rate controller, which provides feedback of motor or sheave rate in order to implement the motion command. The feedback of motor rate to motor torque provides co-located damping of the oscillatory modes so that they are more quickly attenuated. In general, there will be some error in following the nominal trajectory because the oscillations are not attenuated as much as desired. The error is most critical at the end of the flight, where the error is termed "leveling error". The tracking and leveling errors decrease with the bandwidth of the motion control feedback loop and increase with acceleration and deceleration levels.

In tall buildings trajectory following errors are worse because the long rope is more compliant and there is a considerable time delay for the transmission of a motor motion perturbation in the machine room to propagate down the rope to the car. The speed of this tension wave in a typical elevator rope is 2500 to 3500 meters/sec. Thus there is approximately a 0.1 sec delay for a perturbation in the machine room to propagate to the car if the car is 400 meters below the machine room. The presence of this time delay in the motion control feedback loop limits its bandwidth, which limits how quickly the controller reacts to errors in following the nominal flight trajectory and to disturbances. This limitation has two impacts: (1) the elevator vertical oscillations cannot be as well attenuated; and (2) the accuracy to which the car can be made to follow a decelerating trajectory decreases. The taller the building, the greater the impact of time delay. To maintain accuracy at landing (e.g., to minimize leveling errors), the deceleration rate of the car has to be slowed for tall buildings. This increases floor-to-floor flight time and is therefore undesirable. In a 400 meter rise elevator, this floor-to-floor flight time could be increased by 100% to maintain landing accuracy and ride quality. Therefore, a need exists for an improved elevator motion controller which improves the attenuation of oscillations, without increasing flight times, particularly in buildings with long elevator shafts.

To accurately land, the elevator motion control needs to include some degree of position error feedback. A common way to accomplish this is to make the dictated velocity a function of distance-to-go. Although, position feedback is needed to land accurately, it reduces the damping of the oscillatory modes. It is known that a high position gain (i.e., the slope or gain of a dictated speed vs. distance-to-go function) can cause instabilities. It is also known that lowering position gain increases flight time. The degree of position error feedback that can be allowed increases the damping of the oscillatory modes. It is further known in the art that car acceleration feedback to the velocity command (provided to a drive and brake subsystem) increases this damping in modest size buildings. In tall buildings, this is not effective because of the relatively large time delay in propagating motion from the main motor to the car. Therefore, there further exists a need for improved attenuation of oscillations for improved position error feedback control.

SUMMARY OF THE INVENTION

Objects of the invention include improved attenuation and damping of elevator vertical oscillations and mitigation of the impact of time delay on elevator motion control.

Further objects of the invention include both improved elevator ride quality and reduced flight time in tall buildings.

According to the present invention, an elevator motion control system compares a dictated flight path signal, indicative of a desired elevator flight trajectory, with a measured flight path signal, indicative of actual elevator motion, and provides a motion command signal to both a high pass filter and a low pass filter such that the frequency of the motion command signal is split into high and low frequency components, and wherein an active force actuator, located at the elevator car, is used to implement the high frequency/low stroke portion of the motion command signal while the elevator motor is used to implement the low frequency/high stroke portion of the motion command signal.

In further accord with the invention, a time delay is provided for delaying the dictated flight path signal prior to its use with the measured flight path signal for providing the motion command signal, the duration of the time delay corresponding to the delay associated with a motion perturbation propagating along a main rope between the elevator motor and the elevator car.

In still further accord with one embodiment of the invention, the measured flight path signal is indicative of the elevator car acceleration with respect to the hoistway.

In still further accord with another embodiment of the invention, the measured flight path signal is indicative of the elevator car rate with respect to the hoistway.

According further to the invention, the active force actuator is located together with a passive damping device between a hitch and an elevator car frame or between the frame and the car.

The motion control of the invention provides a significant improvement in the control of elevator vertical oscillations and mitigates the impact of time delay on elevator motion control. This significant improvement in elevator control is due to the fact that the active elevator hitch decouples the relationship between flight time and vertical ride quality. The motion control feedback loop can be designed to have a high enough bandwidth to provide accurate trajectory tracking for a smooth ride and an accurate landing, even for reduced flight times. Simulation analysis of this invention implemented in a 400 meter rise high performance elevator shows that if the motion control is split at a frequency where the high frequency component of the motion command involves less than 7 cm of active force actuator travel, then the allowable motion control loop bandwidth is increased sufficiently so that smooth rides are provided in tall buildings without the current need to increase flight times.

The car acceleration, with respect to the hoistway, is provided as feedback for generating the motion command signal, the high frequency portion thereof controlling the force actuator and thereby damping oscillations in the vertical position of the elevator car. The elevator motor control is only required to implement the low frequency portion of the motion command signal, and the force actuator provides for fast enough attenuation such that the rope oscillations are essentially eliminated. This is a very robust form of damping (i.e., it will perform well in spite of unknown changes in car mass and rope compliance) because the force is applied at the same point in the system where the rate is measured. This robust damping essentially eliminates elevator car oscillations caused by the lightly damped low frequency hoistway dynamic modes which are excited by motion commands and other disturbances, as described herein above.

The system of the invention is extremely attractive for implementation. Simulation analysis shows that an active force actuator, having for example a 7 cm stroke, can greatly improve vertical motion control. This actuation requirement can be implemented using the principles of electromagnetic "voice coil" technology, perhaps involving several custom design voice coil actuators in parallel. Alternatively, hydraulic actuation, rotary motors with lead screws, and numerous other actuation methods may be used to implement the actuation requirement of the invention. The various control algorithm components of this invention can all be readily implemented with standard electronic and computer technology.

The foregoing and other objects, features and advantages of the invention will become more apparent in light of the following detailed description of exemplary embodiments thereof.

BEST MODE FOR CARRYING OUT THE INVENTION

The present invention provides a significant improvement in the motion control of an elevator using an active elevator hitch for interconnecting either an elevator car to a main rope or the elevator cab to the elevator frame. The active elevator hitch includes active force actuators acting in parallel and/or in series with passive damping devices and provides improved ride quality and flight time of an elevator, particularly in tall buildings.

Figure 1:
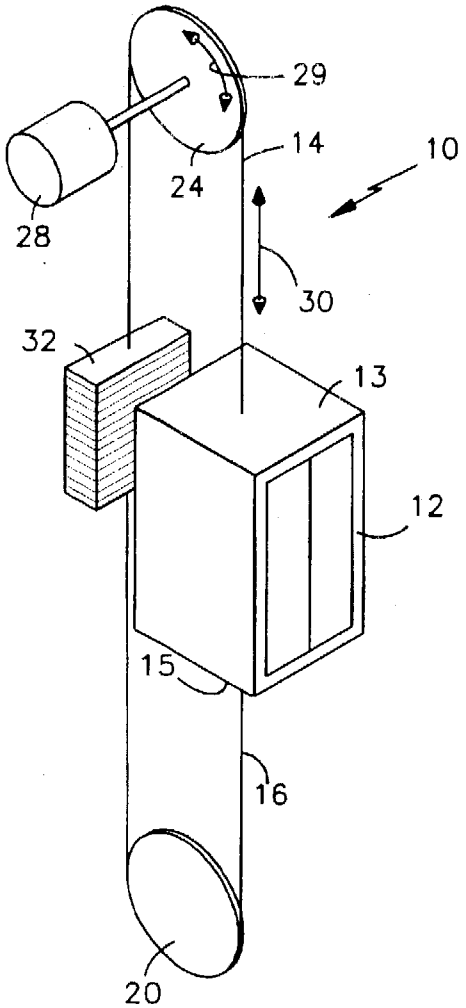
FIG. 1 is a schematic diagram of an elevator.

Referring to FIG. 1, as is known in the art, an elevator 10 includes an elevator car 12 connected at one end 13 to a main rope 14 and, although not necessarily, at the other end 15 to a compensation rope 16 within an elevator shaft (not shown). The compensation rope 16 is received around a compensation pulley 20 and the main rope 14 is received around a sheave 24, e.g., torsion sheave. The sheave 24 is interconnected to a motor 28, e.g., an electric motor or a hydraulic motor, for rotational movement of the sheave 24. Rotational movement 29 of the sheave 24 is translated into longitudinal movement 30 of the elevator car 12 via the main rope 14. As is known in the art, a counterweight 32 may be provided for countering the weight of the elevator car 12. It will be understood by those skilled in the art that the elevator configuration of FIG. 1 is provided to illustrate the general environment of the invention, and various other elevator configurations may be used with the present invention including configurations that do not use a compensation rope and pulley or a counterweight per se, such as a configuration utilizing a linear motor, an alternate roping scheme, and a double wrapped traction scheme on the drive sheave, just to name a few alternate configurations.

Figure 2:
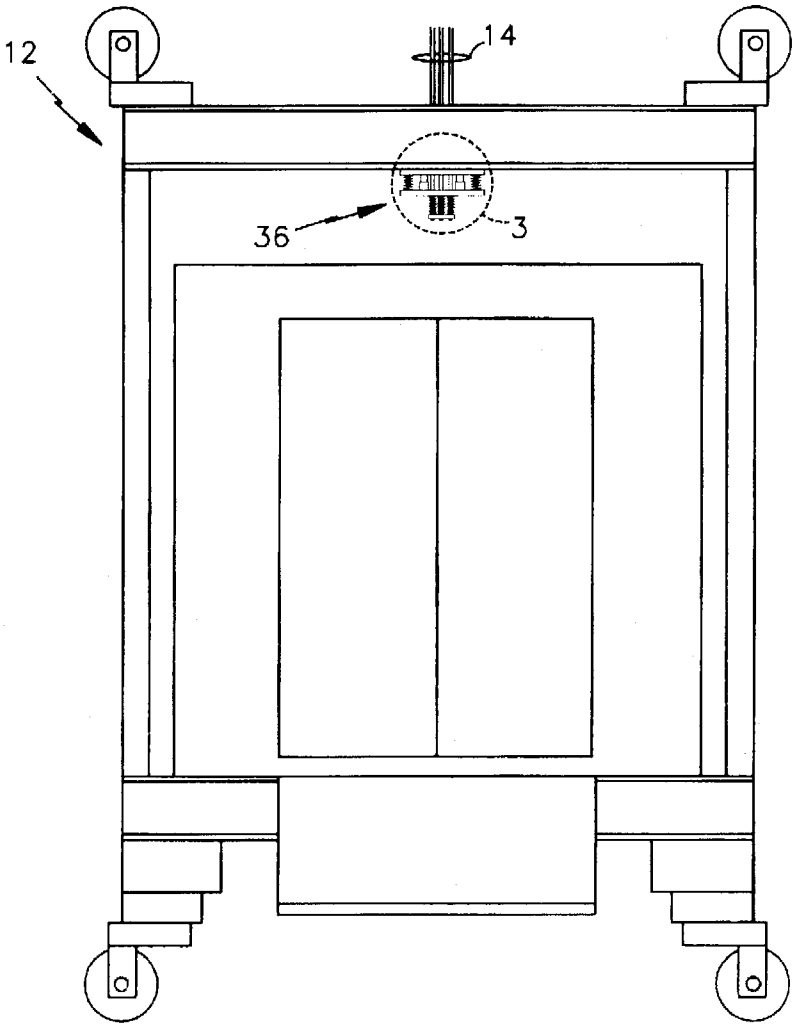
FIG. 2 is a diagram of an elevator car having an active elevator hitch in accordance with the present invention.
Figure 3:
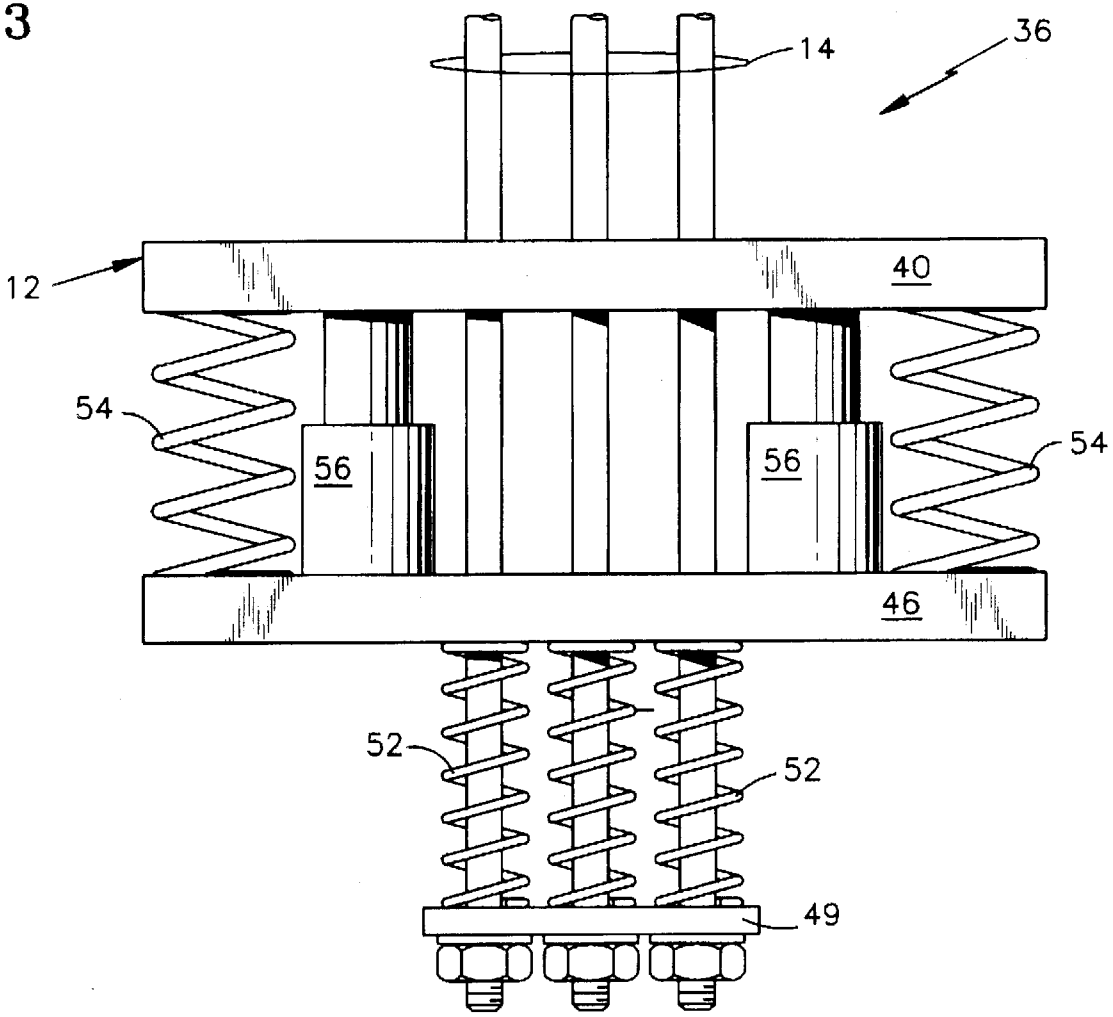
FIG. 3 is a more detailed diagram of the active elevator hitch used with the elevator car of FIG. 2.

Referring now to FIG. 2, the elevator car 12 is interconnected to the main rope 14 by an active hitch assembly 36 which is shown in greater detail in FIG. 3. Referring also to FIG. 3, the active hitch assembly 36 provides for the interconnection of the elevator car 12 to the main rope 14. As illustrated in FIG. 3, the main rope may include a plurality of steel cables, e.g., three (3) steel cables, which are interconnected to the elevator car 12 via the active hitch assembly 36. In the illustrated example, the main rope 14 passes through a support plate 40 and a hitch plate 46 and is attached to mounting plates 49. The support plate 40 may be a separate plate, or it may form part of the elevator frame. Positioned between the mounting plates 49 and the hitch plate 46 are a plurality of passive hitch spring elements 52. In the illustrated example, the passive hitch spring elements 52 positioned between the hitch plate 46 and mounting plates 49 each have one of the steel ropes which make up the main rope 14 passing therethrough. The passive hitch spring elements 52 provide even tension in the steel ropes which make up the main rope.

Positioned between the hitch plate 46 and the support plate 40 are a pair of passive hitch spring elements 54 and a pair of active elements 56 which together with the hitch plate 46 form the active elevator hitch of the present invention. The passive hitch spring elements 54 provide partial support for the elevator car so that the active elements 56 do not need to support the static load of the elevator car. However, depending on the active elements 56 used to implement the active elevator hitch of the present invention, the passive hitch spring elements 54 may be eliminated. The extension of the active elements 56 is controlled by a control system, described in greater detail hereinafter, to thereby provide active damping for the elevator car 12 along its flight path. For example, the active elements 56 may include active force actuators, such as electromagnetic voice coils, the extension (and contraction) of which is provided by control signals applied thereto. Alternatively, the active elements may include active force actuators such as hydraulic actuation, rotary motors with lead screws, and any other actuation methods suitable to implement the actuation requirement of the invention For example, in response to control signals applied thereto, the active force actuators 56 may be controlled to extend or contract over a seven (7) centimeter stroke to thereby improve the vertical motion control of the elevator along its flight path.

Figure 4:
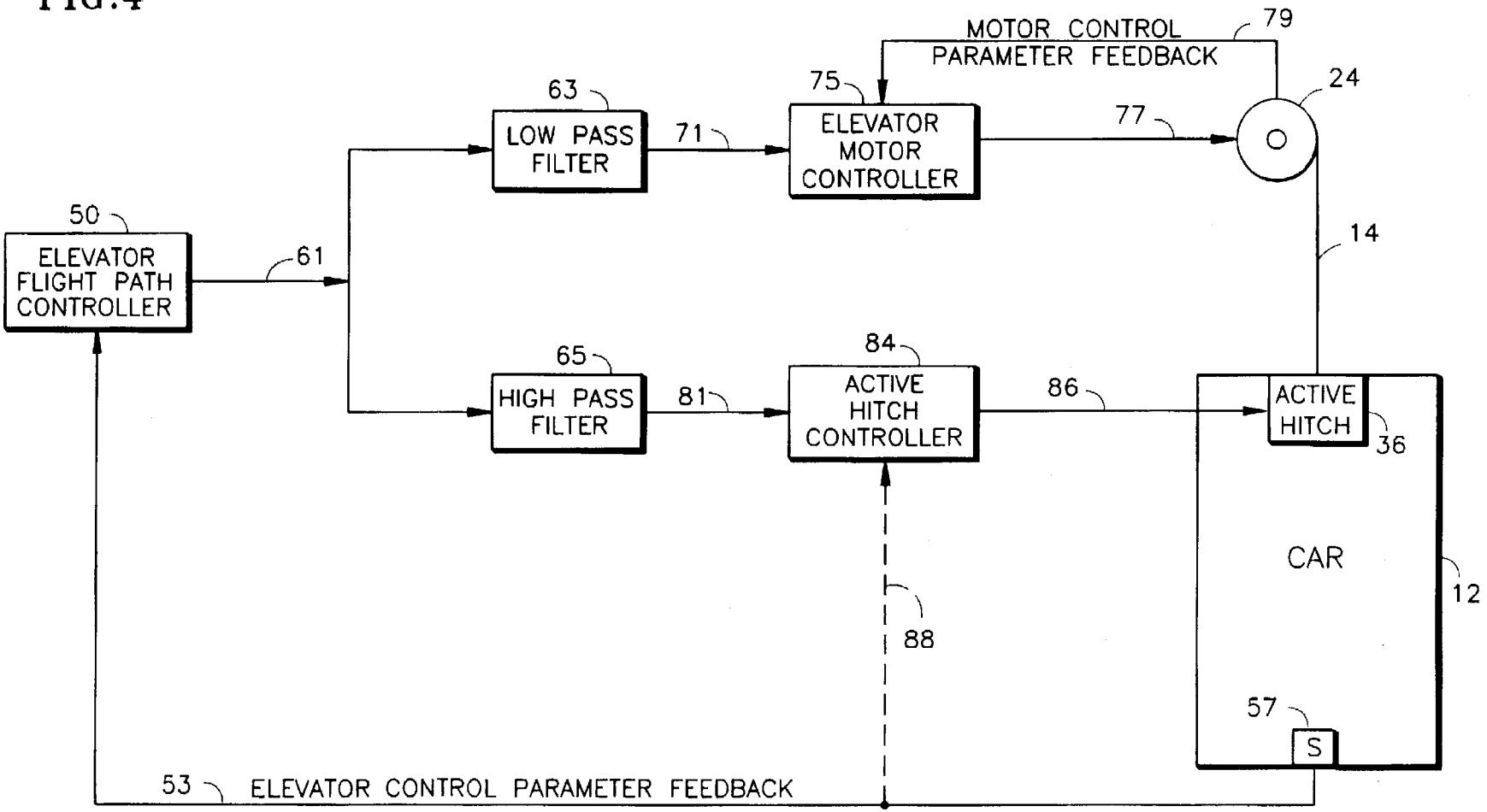
FIG. 4 is a schematic block diagram of a control system for controlling an elevator motor and active elevator hitch in accordance with the present invention.

The control system of FIG. 4 may be used to implement vertical motion control of an elevator car using an active elevator hitch in accordance with the present invention. Referring to FIG. 4, an elevator motion controller 50 is used to generate control signals for controlling the elevator motor 28 (and therefore sheave 24) and the active force actuators 56 (FIG. 3) in the active hitch assembly 36. An input to the elevator motion controller 50 is a feedback signal on the line 53 indicative of the control response of the elevator car 12. The feedback signal on the line 53 may be provided by a sensor 57 mounted directly to the elevator car 12, or alternatively mounted to the active hitch assembly 36, the main rope 14 or other suitable location for providing the feedback signal on the line 53 indicative of the control response of the elevator car 12 to the operation of the motor 28 and active hitch assembly 36.

The elevator motion controller 50 provides a motion command signal on the line 61 which is provided to a low pass filter 63 and a high pass filter 65. The output of the low pass filter 63 is the low frequency component of the motion command signal provided by the elevator motion controller 50. This low frequency component of the motion command signal is provided on a line 71 to an elevator motor controller 75. The elevator motor controller 75 provides control signals on the line 77 to the elevator motor 28 for controlling the speed of the elevator motor 28 (FIG. 1), and therefore sheave 24, to implement only the low frequency portion of the motion command signal. The control response of the elevator motor 28 FIG. 1) and/or sheave 24 to the signals provided on the line 77 is provided as feedback on the line 79 to the elevator motor controller 75 in the way known to the art for controlling the speed of the elevator motor 28 (FIG. 1).

The output of the high pass filter 65 is the high frequency component of the motion command signal provided by the elevator motion controller 50. This high frequency component is provided on a line 81 to an active hitch controller 84. The active hitch controller 84 implements a control algorithm for providing control signals on the line 86 to the active hitch assembly 36 such that the active hitch assembly 36 implements the high frequency portion of the motion command signal.

Therefore, in accordance with the present invention, the elevator motor controller 75 is used to implement the low frequency component of the motion commanded by the elevator motion controller 50 using the elevator motor 28 and sheave 24. The active hitch controller 84 is used to implement the high frequency portion of the motion commanded by the elevator motion controller 50 using the active hitch assembly 36. It has been found that the control provided by this invention provides a significant improvement in ride quality and in flight time in tall buildings.

In a second embodiment of the control system of FIG. 4, the feedback signal is provided on a line 88 directly to the active hitch controller 84. Therefore, the motion command signal on the line 61 is dictated solely by the elevator motion controller 50. In this embodiment, the active hitch controller 84 is responsive to the high frequency portion of the motion command signal and the feedback signal on the line 88 for providing the control signals on the line 86 to the active hitch assembly 36. In a third embodiment of the invention, the active hitch controller 84 provides the control signals on the line 86 to the active hitch assembly 36 based solely on the high frequency portion of the motion command signal without any feedback signal.

Figure 5:
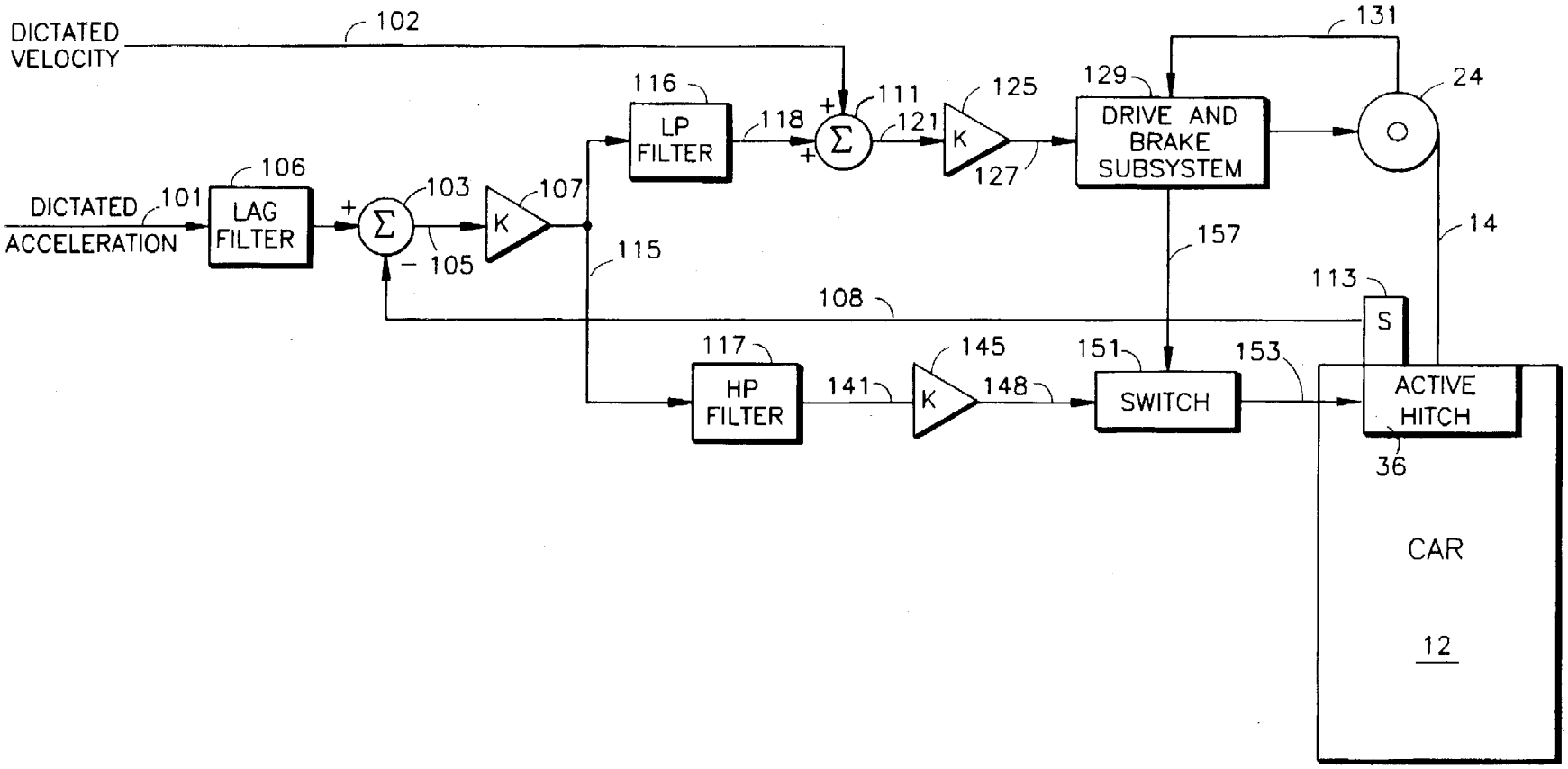
FIG. 5 is a more detailed schematic block diagram of the control system of FIG. 4.

A more detailed embodiment of the invention is illustrated in FIG. 5. Referring to FIG. 5, a dictated acceleration signal is provided on a line 101 to a summing junction 103 via a lag filter 106. A dictated velocity signal is provided on a line 102 to a second summing junction 111. The dictated acceleration signal on the line 101 is an acceleration signal indicative of the desired acceleration of the elevator car 12 during motion of the elevator car. Similarly, the dictated velocity signal on the line 102 is a velocity signal indicative of the desired velocity of the elevator car 12 during motion of the elevator car. The other input to the summing junction 103 is an actual acceleration signal (measured acceleration signal) provided on a line 108. The actual acceleration signal on the line 108 may be provided by a vertical acceleration signal from an accelerometer 113. Alternatively, other devices for providing a signal indicative of elevator acceleration, such as a tachometer, may be used.

As discussed above, the response of the elevator car 12 to commanded changes in elevator speed (due to changes in speed of the elevator motor 28), and to other perturbations, is delayed because of the length of the elevator rope 14. Therefore, the lag filter 106 is provided to simulate the delay associated with the elevator rope 14. The lag filter 106 may have a fixed delay period, or alternatively, it may have a variable delay period based on the distance between the elevator car 12 and the sheave 24. An exemplary transfer function for the lag filter 106 is given in equation 1 below where T is a variable which represents the rope propagation delay, equal to the length of the rope, i.e., the distance from the sheave 24 to the active hitch assembly 36, divided by the speed of sound in the rope:

$$\frac{1}{(Ts+1)} \qquad \text{(eq. 1)}$$

It will be understood by those skilled in the art that other means can be used to simulate the rope propagation delay in accordance with the invention.

The output of the summing junction 103 is an acceleration error signal on a line 105. The acceleration error signal is scaled by a gain function 107 which converts it into a velocity error signal on a line 115, which is provided to both a low pass filter 116 and a high pass filter 117. The low pass filter 116 includes a transfer function for filtering the velocity error signal such that the output of the low pass filter 116 is the low frequency portion of the velocity error signal. Similarly, the high pass filter 117 includes a transfer function such that the output of the high pass filter 117 is the high frequency portion of the velocity error signal. Exemplary transfer functions for the low pass filter and the high pass filter are respectively given in equations 2 and 3 below:

$$\frac{5s+25}{s^2+5s+25} \qquad \text{(eq. 2)}$$

$$\frac{s}{s^2+5s+25} \qquad \text{(eq. 3)}$$

The output of the low pass filter 116 is provided on a line 118 to the summing junction 111 where it is summed with the dictated velocity signal on the line 101 to thereby provide a motor command signal on a line 121. The motor command signal is provided to a gain function 125 to thereby provide a scaled motor command signal on the line 127 which is thereafter provided, e.g., to a drive and brake subsystem 129. The other input to the drive and brake subsystem 129 is a feedback signal indicative of motor rate provided on a line 131. The drive and brake subsystem is responsive to the scaled motor command signal on line 127 and the motor rate on the line 131 for providing a motor torque signal on a line 137 for controlling the speed of the motor 28.

The output of the high pass filter 117 is provided on a line 141 to a gain function 145 the output of which is a hitch command signal on the line 148. The hitch command signal is provided via a switch 151 and a signal line 153 to the active hitch assembly 36 for controlling the extension of the active force actuators 56 (FIG. 3). The extension of the active force actuators 56 is controlled over a variable extension or stroke by the hitch command signal. For example, the force actuators may vary in length by a variable extension or stroke of 7 cm.

The switch 151 is responsive to a signal on the line 157 indicative of the elevator car brakes being activated for discontinuing providing the hitch command signal to the active hitch assembly 36 to thereby freeze the position of the force actuators 56 (FIG. 3) when the elevator car brakes are applied. After the brakes are applied, the active hitch assembly maintains the car position as the payload varies.

Figure 6:
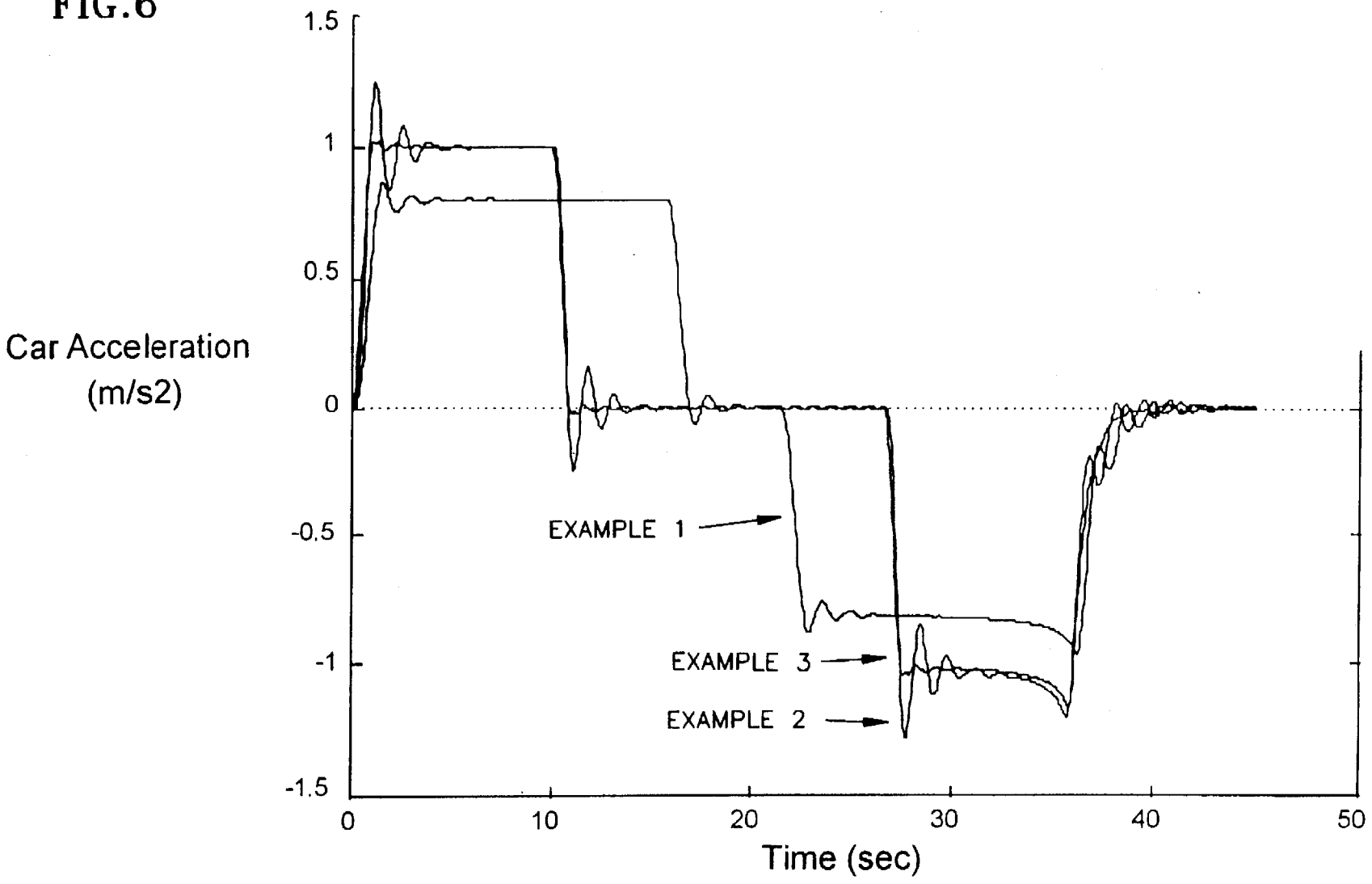
FIG. 6 is a graph illustrating the predicted improvement in elevator ride quality using the present invention.

It has been found via computer simulation that the system of the present invention greatly improves the control of an elevator car, particularly in tall buildings. FIG. 6 is a graph of car acceleration verses time for three different elevator car simulation examples. All three examples assume a 400 meter rise elevator shaft. The third example utilizes an active hitch of the present invention employing active force actuators having a 7 cm stroke. The results of the tests are as follows:

| Example | Flight Time (sec) | Acceleration Overshoot (mGs) | Acceleration at Landing (mGs) | Dictated Acceleration ($m/s^2$) | Maximum Velocity (M/s) |
|---|---|---|---|---|---|
| Example 1 Baseline (no active hitch) | 40.0 | 6.8 | 16.7 | 0.8 | 12.5 |
| Example 2 Attempt to Improve flight time (no active hitch) | 39.6 | 25.2 | 21.7 | 1.0 | 10.0 |
| Example 3 Improved ride quality (using active hitch) | 39.7 | 2.5 | 0.1 | 1.0 | 10.0 |

It can be seen from the above simulation examples that the active elevator hitch of the invention provides similar flight time and improved ride comfort. This significant improvement in elevator control is due to the fact that the active elevator hitch decouples the relationship between flight time and vertical ride quality.

The invention is described as using dictated acceleration and measured acceleration for implementing control of the active elevator hitch of the invention. However, the control of the invention may also be implemented with dictated and measured velocity signals. In this case the measured velocity signal may be provided for example by integrating the measured acceleration signal. In this case, the transfer functions of the high pass and low pass filters must be modified by multiplying each numerator by "s".

The invention has been described as using a pair of active force actuators 56 (FIG. 3) for implementing the active elevator hitch. However, it will be understood by those skilled in the art that one or more active force actuators may be used, depending on the specific elevator application. Additionally, although the active force actuators 56 are described as being potentially electromagnetic voice coil technology, hydraulic actuation, or rotary motors with lead screws, any suitable device having a variable extension controllable by the application of a control signal thereto, either directly or indirectly, may be used to implement the active elevator hitch of the invention.

The invention is described as using dictated and actual (measured) velocity and acceleration parameters for controlling the active elevator hitch. However, any suitable parameters suitable for controlling the motion of an elevator may be used with the present invention. Additionally, although the active elevator hitch is described as being positioned between a hitch plate 46 (FIG. 3) and an elevator frame 40 (FIG. 3), the invention would work equally as well if the active elevator hitch is positioned between the elevator car and the elevator frame.

The active hitch assembly 36 is illustrated in FIG. 3 as including passive damping elements connected both in series (passive hitch spring elements 52) and in parallel (passive hitch spring elements 54) with the active elements 56. However, the invention will work equally as well with passive damping elements connected in series and/or in parallel with the active elements 56.

Although the invention has been described and illustrated with respect to exemplary embodiments thereof, the foregoing and various other changes, omissions and additions may be made therein and thereto without departing from the spirit and scope of the present invention.

What is claimed is:

1. A system for active damping of oscillations during vertical motion of an elevator car position along an elevator flight path, the elevator car being connected by a rope to a sheave mounted to an elevator motor, the system comprising:

means for providing a dictated flight path signal indicative of a desired vertical motion of the elevator car along the elevator flight path;

motion command means responsive to said dictated flight path signal for providing a motion command signal;

a high pass filter responsive to said motion command signal for providing a force command signal indicative of the high frequency portion of said motion command signal; and force actuator means responsive to said force command signal, said force actuator means having a variable extension which is controlled by said force command signal for varying the vertical position of the elevator car along the elevator flight path by said variable extension.

2. The system of claim 1, further comprising delay means for delaying said dictated flight path signal by a delay period for providing a delayed dictated flight path signal, and wherein said motion command means is responsive to said delayed dictated flight path signal for providing said motion command signal.

3. The system of claim 2, wherein said delay period is a variable period having a duration directly related to a length of the rope between the elevator car and the sheave.

4. The system of claim 2, further comprising:

means for providing a brake signal when an elevator brake is applied, and switch means responsive to said brake signal for removing said force command signal from said force actuator means.

5. The system of claim 2, further including:

a low pass filter responsive to said motion command signal for providing a low frequency motion command signal indicative of the low frequency portion of said motion command signal; and means responsive to said dictated flight path signal and said low frequency motion command signal for providing a motor control signal for controlling the speed of the elevator motor.

6. The system of claim 5, further comprising means for providing a motor feedback signal indicative of the response of the elevator motor to said motor control signal, and wherein said motor control signal is modified by said motor feedback signal.

7. The system of claim 6, wherein said delay period is a variable period having a duration directly related to a length of the rope between the elevator car and the sheave.

8. The system of claim 7, wherein said delay means includes a lag filter.

9. The system of claim 3, wherein said delay means includes a lag filter.

10. The system of claim 1, further comprising means for providing a measured flight path signal indicative of actual vertical motion of the elevator car alone the elevator flight path with respect to the elevator hoistway and wherein said motion command means is responsive to said measured flight path signal for providing said motion command signal.

11. The system of claim 10, further including an accelerometer mounted to said elevator car for providing said measured flight path signal.

12. The system of claim 10, wherein said desired vertical motion is indicative of a desired velocity of the elevator car with respect to an elevator hoistway, and wherein said measured flight path signal is indicative of an actual velocity of the elevator car with respect to the elevator hoistway.

13. The system of claim 12, further including:

an accelerometer mounted to said elevator car for providing an acceleration signal indicative of an acceleration of the elevator car; and an integrator responsive to said acceleration signal for providing said measured flight path signal indicative of the actual velocity of the elevator car.

14. The system of claim 1, wherein said force actuator means includes at least one electromagnetic device.

15. The system of claim 1, wherein said force actuator means includes at least one hydraulic actuator.

16. The system of claim 1, wherein said force actuator means includes at least one rotary motor and lead screw.

17. The system of claim 1, further including passive damping means connected in parallel or in series with said force actuator means.

18. The system of claim 1, further including passive damping means connected both in parallel and in series with said force actuator means.

19. The system of claim 18, wherein said passive damping means and said force actuator means are mounted together between either the elevator car and an elevator car frame or between the elevator car frame and a hitch assembly.

20. An active elevator hitch for active damping of oscillations during vertical motion of an elevator car position along an elevator flight path, the elevator car being connected by a rope to a sheave mounted to an elevator motor, the active elevator hitch comprising:

a support plate interconnected to the elevator car;

a hitch plate;

at least one force actuator means having a variable extension, said at least one force actuator means being connected between said hitch plate and said support plate;

control means for controlling said at least one force actuator means including:

(a) motion command means for providing a motion command signal;

(b) a high pass filter responsive to said motion command signal for providing a force command signal indicative of the high frequency portion of said motion command signal;

(c) a low pass filter responsive to said motion command signal for providing a low frequency motion command signal indicative of the low frequency portion of said motion command signal; and (d) means responsive to said low frequency motion command signal for providing a motor control signal for controlling the speed of the elevator motor; and wherein said force command signal is provided to said at least one force actuator for controlling said variable extension for varying the vertical position of the elevator car along the elevator flight path for damping the high frequency components of the oscillations.

21. The active elevator hitch according to claim 20, wherein said control means further includes:

means for providing a dictated flight path signal indicative of a desired vertical motion of the elevator car along the elevator flight path;

means for providing a measured flight path signal indicative of actual vertical motion of the elevator car along the elevator flight path; and wherein said motion command means is responsive to said dictated flight path signal and said measured flight path signal for providing said motion command signal.

22. The active elevator hitch according to claim 21, wherein said control means further includes:

delay means for delaying said dictated flight path signal by a variable period having a duration directly related to a length of the rope between the elevator car and the sheave for providing a delayed dictated flight path signal; and wherein said motion command means is responsive to said delayed dictated flight path signal and said measured flight path signal for providing said motion command signal.

23. The active elevator hitch according to claim 20, further including passive damping means connected in parallel with said at least one force actuator means between said hitch plate and said support plate.

24. The active elevator hitch according to claim 23, further including:

a mounting plate connected to the rope;

second passive damping means connected in series with said at least one force actuator means between said mounting plate and said hitch plate; and wherein said support plate is connected to an elevator car frame.

25. The active elevator hitch according to claim 24, wherein said support plate forms part of the elevator car frame.

26. The active elevator hitch according to claim 23, wherein said support plate is connected to an elevator car frame, and wherein said hitch plate is connected to the elevator car.

* * * * *